US007942003B2

(12) United States Patent
Baudoin et al.

(10) Patent No.: US 7,942,003 B2
(45) Date of Patent: May 17, 2011

(54) DUAL-INJECTOR FUEL INJECTOR SYSTEM

(75) Inventors: Christophe Baudoin, Brie Comte Robert (FR); Michel Andre Albert Desaulty, Vert St Denis (FR); Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 785 days.

(21) Appl. No.: 12/018,520

(22) Filed: Jan. 23, 2008

(65) Prior Publication Data

US 2008/0236165 A1 Oct. 2, 2008

(30) Foreign Application Priority Data

Jan. 23, 2007 (FR) ..... 07 52820

(51) Int. Cl.
*F02C 1/00* (2006.01)
*F02G 3/00* (2006.01)

(52) U.S. Cl. ..... 60/748; 60/752; 60/747

(58) Field of Classification Search ..... 60/740, 60/742, 746, 747, 748, 737, 752–760
See application file for complete search history.

(56) References Cited

U.S. PATENT DOCUMENTS

| | | | | |
|---|---|---|---|---|
| 5,865,024 | A * | 2/1999 | Kress et al. | 60/39.463 |
| 6,327,861 | B2 * | 12/2001 | Sato et al. | 60/746 |
| 6,363,726 | B1 * | 4/2002 | Durbin et al. | 60/748 |
| 6,367,262 | B1 * | 4/2002 | Mongia et al. | 60/748 |
| 6,418,726 | B1 * | 7/2002 | Foust et al. | 60/776 |
| 6,820,425 | B2 * | 11/2004 | David et al. | 60/743 |
| 6,986,255 | B2 * | 1/2006 | Smith et al. | 60/776 |
| 7,434,401 | B2 * | 10/2008 | Hayashi | 60/743 |
| 7,779,636 | B2 * | 8/2010 | Buelow et al. | 60/742 |
| 2002/0162333 | A1 * | 11/2002 | Zelina | 60/776 |
| 2007/0137207 | A1 * | 6/2007 | Mancini et al. | 60/737 |
| 2008/0173019 | A1 * | 7/2008 | Kobayashi et al. | 60/739 |
| 2008/0302105 | A1 * | 12/2008 | Oda et al. | 60/737 |
| 2009/0113893 | A1 * | 5/2009 | Li et al. | 60/737 |
| 2010/0269506 | A1 * | 10/2010 | Nonaka et al. | 60/742 |

FOREIGN PATENT DOCUMENTS

| | | |
|---|---|---|
| EP | 1 193 449 A2 | 4/2002 |
| EP | 1 193 450 A1 | 4/2002 |
| EP | 1 413 830 A2 | 4/2004 |
| FR | 1 314 933 A1 | 5/2003 |
| FR | 1 806 536 A1 | 7/2007 |

* cited by examiner

*Primary Examiner* — William H Rodriguez
(74) *Attorney, Agent, or Firm* — Oblon, Spivak, McClelland, Maier & Neustadt, L.L.P.

(57) ABSTRACT

A fuel injector system for injecting fuel into a turbomachine combustion chamber, the system comprising first and second fuel injectors wherein the first injector (22) is positioned in the center of the injector system (20) so as to inject a first fuel spray (42), and wherein the second injector (28) surrounds the first injector in such a manner as to inject a second fuel spray (48) of generally annular shape around the first fuel spray. The injector system further comprises an air admission duct (22) with outlet orifices (62) opening out between the first and second injectors so as to create a separator air film (f1) between the respective combustion zones of the first and second fuel sprays.

13 Claims, 4 Drawing Sheets

DUAL-INJECTOR FUEL INJECTOR SYSTEM

The invention relates to a fuel injector system for injecting fuel into a turbomachine combustion chamber, and to a turbomachine combustion chamber fitted with such a system. The invention is suitable for any type of turbomachine, whether for aeronautical or land use, and more particularly it relates to airplane turbojets.

A turbojet combustion chamber is generally annular in shape, centered on an axis X corresponding to the axis of rotation of the turbojet rotor. It comprises two annular walls (or shrouds) disposed coaxially about the axis X, together with a chamber end wall disposed between said annular walls, in the upstream region of said chamber, where the terms "upstream" and "downstream" are defined relative to the normal flow direction of gas through the chamber. Said annular and end walls of the chamber define the combustion enclosure of the chamber.

A plurality of injector systems for injecting fuel into the chamber are fastened to the end wall of the chamber and are distributed regularly around the axis X. Most common injector systems comprise a single fuel injector. The design (i.e. shape, structure, choice of materials, . . . ) of combustion chambers fitted with single injector systems is nowadays well mastered and reference is made below to chambers of conventional design.

In chambers of conventional design, each injector system is fastened and positioned within a single orifice provided for that purpose in the end wall of the chamber, such that the injector system is relatively simple to mount. In addition, during combustion, the temperature profile at the outlet from the chamber remains centered on a circle of determined diameter around the axis X, regardless of the operating speed of the turbojet. Such a temperature profile simplifies designing the portions of the turbojet that are situated downstream from the chamber.

Nevertheless, with injector systems having a single-injector, it is difficult to control the richness of the air/fuel mixture being burned, as a function of the operating speed of the turbojet, i.e. whether it is operating at idling speed or at full speed. Thus, at certain speeds, combustion is accompanied by the emission of polluting gases (in particular nitrogen oxides or "NOx"), which gases are dangerous for health and for the environment.

In order to limit the emission of polluting gas, dual-injector fuel injector systems have been developed. The two injectors serve to create two combustion zones, one optimized for idling speed of the turbojet and the other for full speed.

Document FR 2 706 021 describes an annular combustion chamber for a turbojet that is fitted with a plurality of dual-injector injector systems. The chamber is centered on an axis X and the injector systems are distributed around the axis X, each system comprising two injectors disposed one after another in a radial direction relative to the axis X. Thus, for a chamber fitted with N injector systems, a first row of N injectors is disposed on a circle of diameter d about the axis X, and a second row of N injectors is disposed on a circle of diameter D, greater than d, about the axis X.

Although it presents the advantage of polluting little, the dual-injector injector system of FR 2 706 021 suffers from the drawback of being difficult to mount since it is necessary to position and secure each injector to the end wall of the chamber. In addition, the design of the combustion chamber is more complex and less well mastered than is the above-mentioned conventional design (which leads in particular to difficulties in ensuring good ability to withstand high temperatures and proper lifetime for certain elements of the chamber). Finally, during combustion, the temperature profile at the outlet from the chamber varies significantly as a function of the operating speed of the turbojet, and in particular the profile does not remain centered on a circle of determined diameter about the axis X. This complicates the design of those portions of the turbojets that are situated downstream from the combustion chamber.

An object of the invention is to propose a fuel injector system that pollutes little and that can be used with a combustion chamber of conventional design, i.e. a chamber of the type usually fitted with single-injector injector systems.

This object is achieved by a fuel injector system for injecting fuel into a turbomachine combustion chamber, the system comprising:

- first and second fuel injectors, the first injector being positioned at the center of the injector system so as to inject a first fuel spray, and the second injector surrounding the first injector so as to inject a second fuel spray of generally annular shape around the first fuel spray; and
- first and second air admission passages associated respectively with the first and second injectors in such a manner as to form respective first and second air/fuel mixtures, said injector system further comprising an air admission duct with outlet orifices opening out between the first and second injectors in such a manner as to create a separator air film between the respective combustion zones of the first and second air/fuel mixtures.

The injector system of the invention thus comprises two injectors, thereby enabling the richness of the air/fuel mixture to be adapted to the operating speed of the turbojet, and serving to limit the emission of polluting gases.

In addition, since the second injector is positioned around the first, this type of system can be adapted to a chamber of conventional design, and in particular a chamber having only a single orifice formed through the chamber end wall for each injector system.

In a first embodiment of the second injector, it presents a circular injection slot surrounding the first injector, and in a second embodiment, it presents a plurality of injection orifices disposed in a circle around the first injector.

In a particular embodiment, the first injector, the first air admission passage, and the second injector form part of a first assembly designed to be mounted on a second assembly comprising the second air admission passage, said second assembly being designed to be mounted on said combustion chamber.

By means of such a system, it is possible firstly to position and mount the second assembly on the chamber end wall without being hindered by the injectors, and then to mount the first assembly on the second. The second assembly then serves as a guide for mounting the first.

It should be observed that the relative position of the first and second injectors is generally imposed by the shape of the first assembly and therefore does not need to be adjusted during mounting.

In a particular embodiment, the second assembly is mounted on the chamber end wall while retaining the ability to move radially about the injection axis I of the first injector, and it can move along said axis relative to the first assembly, while remaining centered relative thereto.

The invention and its advantages can be even better understood on reading the following detailed description of an example of an injector system of the invention.

The description refers to the accompanying figures, wherein.

Figure 1:
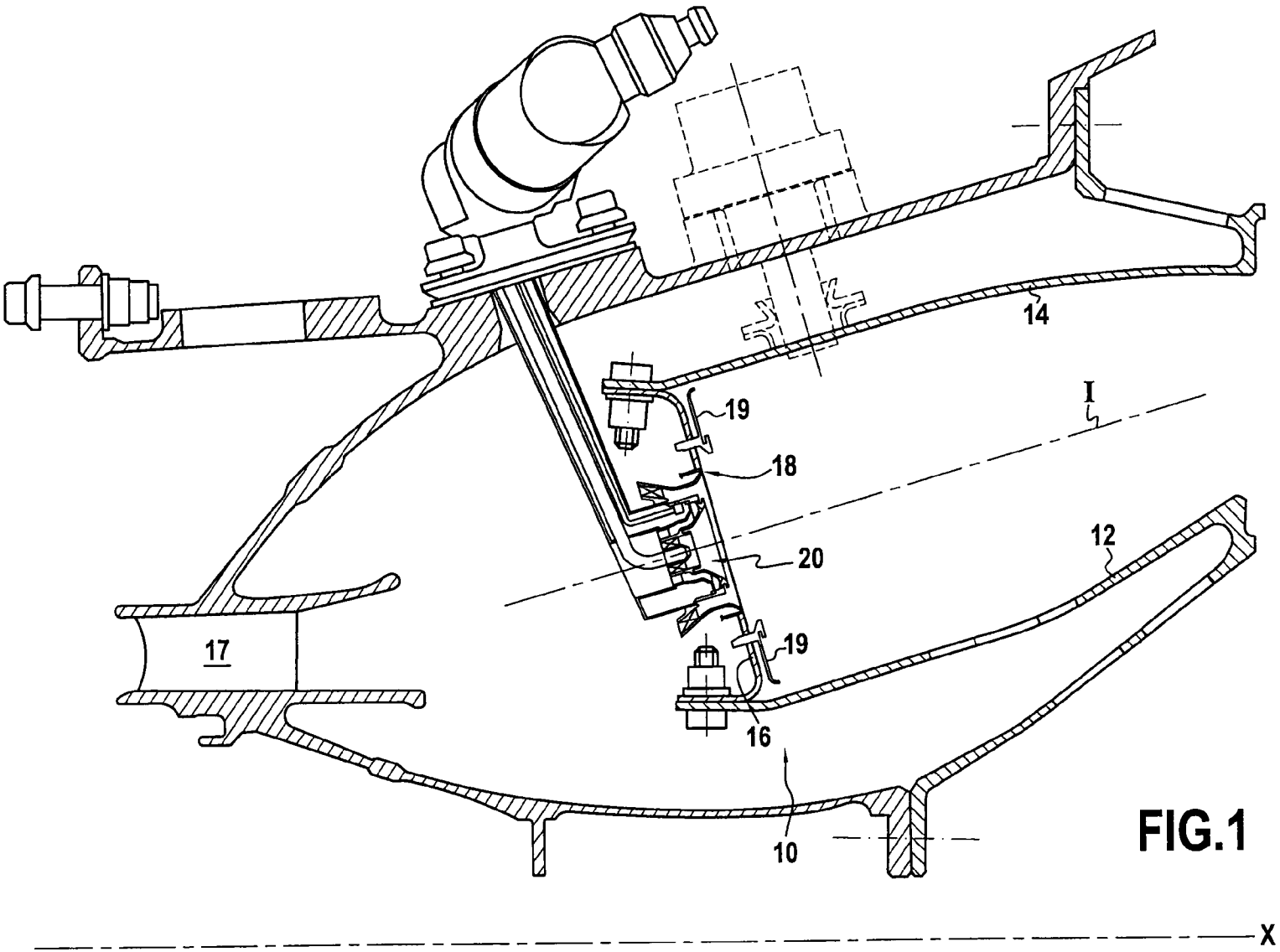
FIG. 1 shows an example of a combustion chamber fitted with an example of an injector system of the invention, the figure being in axial half-section on a plane including the axis of rotation of the turbojet.
Figure 3:
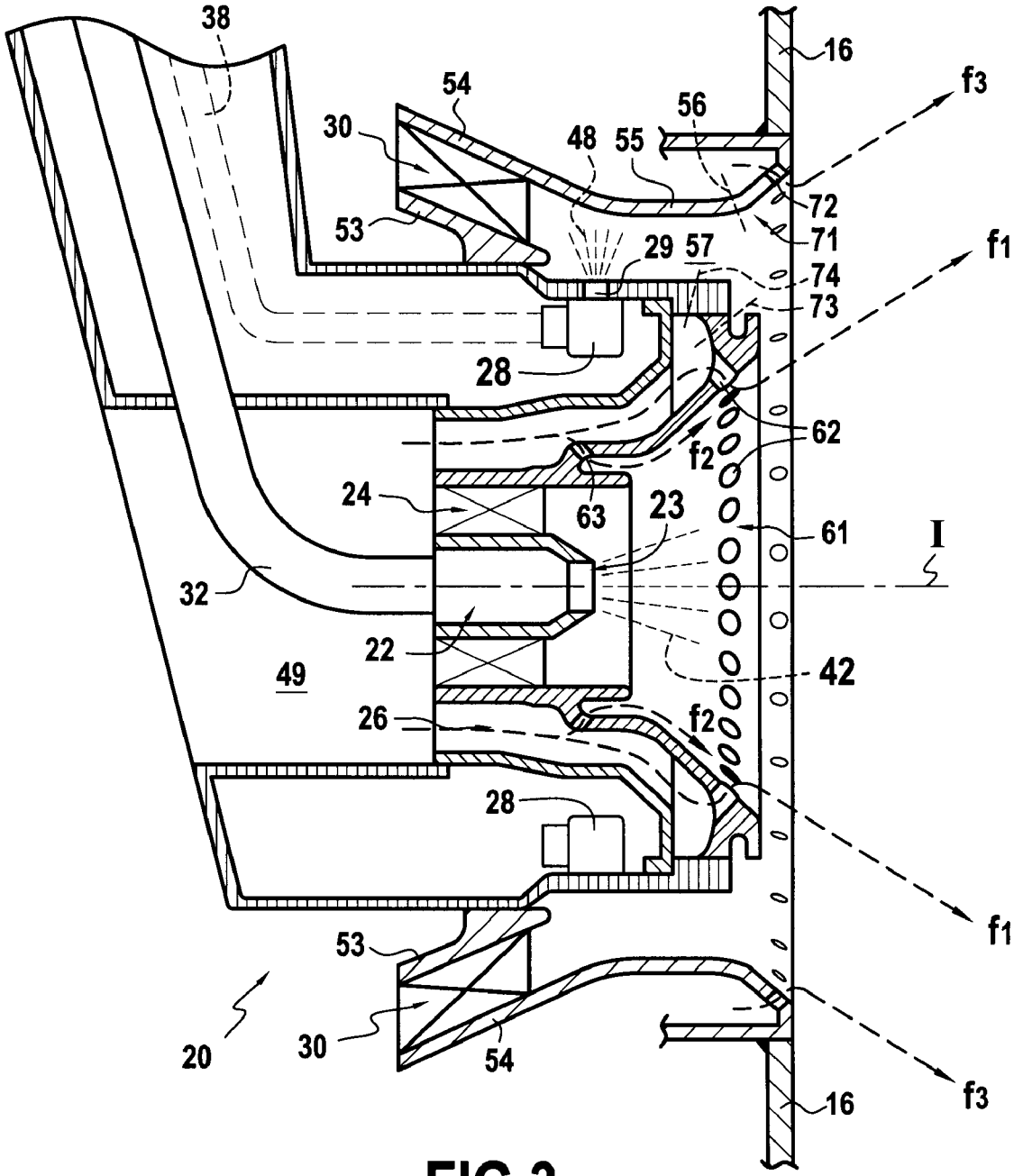
Figure 4:
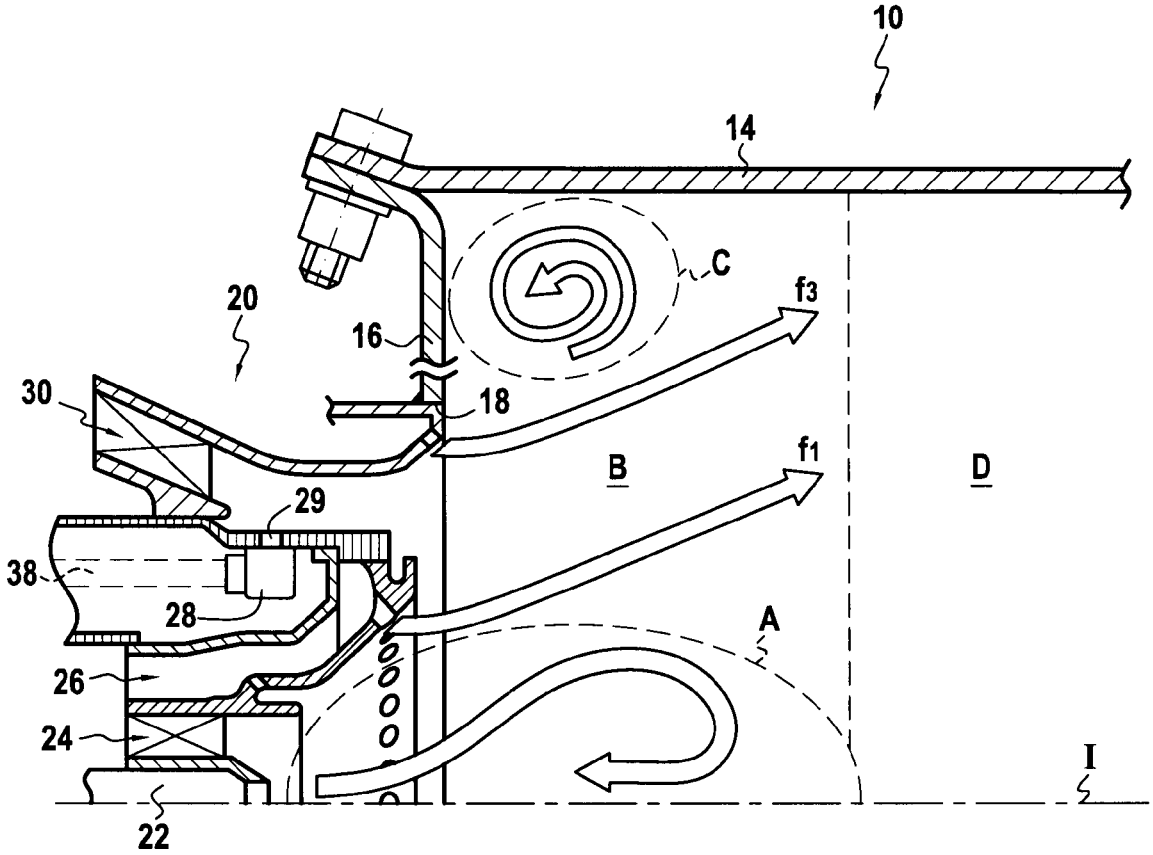

FIG. 3 shows the injector system of FIG. 1, on is own, in axial section on a plane containing the injection axis of the first injector; and FIG. 4 is a detail view in axial half-section on a plane containing the injection axis of the first injector, showing the injection system and a portion of the combustion chamber shown in FIG. 1. In FIG. 4 there can be seen the flow zones of the various fluids passing through the injector system.

The example combustion chamber 10 of FIG. 1 is shown in its environment inside a turbojet. The chamber 10 is annular, being centered on the axis X which is also the axis of rotation of the turbojet. The combustion chamber is said to be axial since it is oriented substantially along the axis X.

The invention could be applied to other types of turbomachine and to other types of chamber, in particular to so-called radial combustion chambers with return, i.e. angled combustion chambers in which a portion is oriented substantially radially relative to the axis of rotation of the turbojet.

The combustion chamber 10 has two annular walls (or shrouds) respectively an inner wall 12 and an outer wall 14. These walls 12 and 14 are spaced apart mutually and they are positioned coaxially around the axis X. The walls 12 and 14 are interconnected by a chamber end wall 16 disposed between them, in the upstream region of the chamber 10. The walls 12, 14 and the end wall 16 define between them the combustion enclosure of the chamber 10.

The chamber end wall 16 presents a plurality of openings 18 that are regularly distributed around the axis of rotation X. The chamber 10 also has deflectors 19 mounted on the chamber end wall 16 at the periphery of the openings 18 so as to protect the end wall 16 from the high temperatures reached during combustion.

Inside each opening 18 there is mounted a fuel injector system 20 of the invention. The system 20 is shown in detail in FIGS. 2 and 3.

It should be observed that the combustion chamber 10 is of conventional design, i.e. its general shape, its structure, etc., are comparable to those of a combustion chamber fitted with injector systems, each having a single injector. Naturally, the combustion chamber 10 is designed to take account of the particular features of the injector system 20, and in particular the orifices 18 are of a size that is adapted to the size of the injector systems 20, which are of diameter greater than the diameter of conventional injector systems 20.

At its center, each injector system 20 comprises a first fuel injector 22 (also known as a "pilot" injector) serving to inject fuel along an injection axis I. Around the first injector 22 the injector system 20 comprises, and in this order: a first air admission passage 24, an air admission duct 26, a second fuel injector 28, and a second air admission passage 30.

The injector system 20 is substantially a body of revolution about the axis I, with the elements making it up being generally annular in shape and distributed coaxially about the axis I.

In the example, the first and second air admission passages 24 and 30 are air swirlers, i.e. annular passages serving to impart rotary movement (about the axis I) to the air passing therethrough. The compressed air passing through the admission passages 24 and 30 comes from the diffuser 17 of the turbojet (see FIG. 1).

The first and second injectors 22 and 28 are fed with fuel via respective feed pipes (or manifolds) 32 and 38. In the example, the second injector 28 is fed by a single pipe 38. Alternatively, the second injector 28 could be fed by a plurality of pipes connected to different points of the circumference of the injector 28.

The first and second injectors 22 and 28 may be fed with fuels that are identical or different. In particular, an arrangement specific to using hydrogen can be implemented for the second injector 28.

The first injector 22 serves to inject a first spray 42 of fuel (see FIG. 3) into the center of the injector system 20 via an injection orifice 23 centered on the axis I. The spray 42 of fuel is generally conical in shape and centered on the axis I.

The second injector 28 is annular in shape and enables a second spray 48 of fuel to be injected via a circular injection slot 29 centered on the axis I (see FIG. 3). This second spray 48 of fuel is generally annular in shape, being substantially centered on the axis I, and it surrounds the first spray 42.

The fuel emitted by the injectors 22 and 28 is mixed with air, the air coming from the air admission passages 24 and 30. These passages 24 and 30 are situated around the injectors 22 and 28 respectively, upstream from the injection orifice 23 and from the injection slot 29.

In an embodiment, the second injector 28 is also configured so as to impart rotary movement (about the axis I) to the spray 48 of fuel. Under such circumstances, the rotary movement of the air coming from the admission passage 30 may be in the same direction (co-rotating) or in the opposite direction (contra-rotating) relative to the spray 48 of fuel.

The first air admission passage 24 is defined between inner and outer walls 43 and 44 that are generally annular in shape and centered on the axis I.

The inner wall 43 surrounds the first injector 22.

The outer wall 44 is extended downstream by a diverging wall 45, i.e. a wall that defines a duct of generally frustoconical shape referred to as a bowl 61 and presenting a section that increases in the flow direction of the first air/fuel mixture (i.e. going from upstream to downstream).

The air admission duct 26 is defined between the walls 44 and 45 on one side and the wall 46 on the other side, the wall 46 surrounding the walls 44 and 45. Radial structural arms 47 interconnect the walls 44 and 46 and keep them mutually spaced apart. In order to ensure that the air admission duct 26 and the first air admission passage 24 are well supplied with air, the injector system 20 presents a recess 49 upstream from the duct 26 and the passage 24. In the example shown, this recess is cylindrical, of outside diameter corresponding substantially to the outside diameter of the duct 26. Only the feed duct 32 for the first injector 22 passes through the recess 49.

The air admission duct 26 includes a first series of outlet orifices 62 passing through the diverging wall 45 near the downstream end thereof, these orifices 62 being disposed in a circle around the first injector 22 (downstream therefrom). It further includes a second series of outlet orifices 63 passing through the diverging wall 45 upstream from said first series of orifices 62, the orifices 63 being disposed in a circle around the first injector (downstream therefrom). Advantageously, the orifices 62 and 63 are regularly distributed around the first injector 22.

The second injector 28 is disposed around the wall 46.

The first injector 22, the air admission passage 24, the bowl 61, the duct 26, and the second injector 28 are all united within a first assembly 51 defined by an outer wall 50. This wall 50 is connected to the downstream ends of the walls 45 and 46 so that it contributes, together with the wall 46, to defining a housing for the second injector 28, and together with the walls 44, 45, and 46 to define the duct 26.

The first assembly 51 is surrounded by a second assembly 52. These assemblies 51 and 52 are mounted one after the other on the end wall 16 of the combustion chamber 10: the assembly 52 is mounted initially on the end wall, inside the orifice 18, and then the assembly 51 is mounted inside the assembly 52.

The second assembly 52 has two annular walls, an inner wall 53 and an outer wall 54, which walls are mutually spaced apart and define between them the second air admission passage 30. The outer wall 54 and the inner wall 53 flare upstream so as to avoid interfering with mounting the assembly 51 on the assembly 52, said mounting taking place from the rear of the assembly 52 (i.e. going from upstream to downstream).

The outer wall 54 is extended downstream by a cylindrical wall 55 and then by a diverging wall 56.

The cylindrical wall 55 co-operates with the outer wall 50 to form an annular channel 57 within which the spray 48 of fuel is injected. This channel 57 is situated to extend the second air admission passage 30 in a downstream direction.

Like the wall 45, the diverging wall 56 forms a frustoconical duct that is flared downstream, referred to as a bowl 71. This diverging wall 56 has a series of orifices 72 passing therethrough in the vicinity of its downstream end, the orifices being disposed in a circle around the second injector 28, downstream therefrom.

With the structure of the injector system 28 of FIG. 1 clearly understood, there follows a description of the functions and advantages of such a system.

Firstly, the term "idling" module or "pilot" module is used to designate the assembly comprising the first fuel injector 22 and the first air admission passage 24, while the term "full-throttle" module is used to designate the assembly comprising the second fuel injector 28 and the second air admission passage 30. It should be observed that these modules do not correspond to the above-described assemblies 51 and 52. It should also be observed that the modules are disposed coaxially around the injection axis I.

In the same manner, two fuel circuits are defined: an "idling" circuit comprising the feed duct 32 and the first injector 22, this circuit opening out to the center of the injector system via the injection orifice 23; and a "full-throttle" circuit comprising the feed duct 38 and the second injector 28, this circuit opening out into the periphery of the injector system, via the injection slot 29.

The control of the operation of the idling and full-throttle modules, and in particular the way in which the distribution of fuel between these two modules is varied as a function of the speed of operation of the turbojet, are defined in such a manner as to limit the emission of toxic gas over the entire operating range of the engine.

When starting or restarting the engine (i.e. during ignition and flame-propagation stages), both modules can be used.

During the spinning-up stage and at low speeds, the idling module operates on its own. At a speed greater than the speed corresponding to thrust at 10% to 30% of full-throttle thrust, both modules are in operation with fuel being distributed appropriately to limit toxic gas emission.

With reference to FIG. 3, there follows a description of the flows of air and fuel passing through the idling module.

The first injector 22 injects the first fuel spray 42. The first air admission passage 26 generates a turbulent air flow that picks up the injected fuel and contributes to atomizing it and mixing it.

An air film f2 possessing a gyratory component is generated by the second series of orifices 63 in the air admission duct 26. This air film f2 has the following functions: protecting the diverging wall 45 against the risks of coking; controlling the precession movements of the vortex generated by the first air admission passage 24, where such movement can give rise to combustion instability; controlling the axial position of the backflow zone of the idling module so as to eliminate any risk of flashback; controlling heat transfer at the end of the injector 22, thereby reducing the risk of coking the fuel circuit at the nose of the injector 22; and improving flame propagation from the idling module to the full-throttle module, during a transition between idling speed and full-throttle speed.

An air film f1 is generated by the first series of orifices 62 in the air admission duct 26. This air film f1 has the following functions: controlling the radial expansion of the fuel spray 42 coming from the first injector 22 and isolating the air coming from the second air admission passage 30, thereby serving to maintain richness at a level that is sufficient to limit the formation of CO/CHx while idling; and damping combustion instabilities between the two modules. It should be observed that the orifices 62 of the first series may all be identical in size, or they may be of varying sizes (per sector) in order to improve the compromise between performance at idling speed where it is necessary to isolate the combustion zone of the first air/fuel mixture, and operability, which is enhanced by intercommunication between the idling zone and the full-throttle zone in order to ensure flame propagation.

It should be observed that other air films can be generated by other series of orifices, and in particular by series of orifices 73 and 74 provided in the end of the air admission duct 26 and represented by dashed lines in FIG. 3. These series of orifices 73 and 74 generate cooling air films, and in particular the air film from the orifices 73 serves to cool the downstream rim of the bowl 61.

There follows a description of the flows of air and fuel passing through the full-throttle module.

It is recalled that the second fuel spray 48 can be injected via a circular slot 29, as shown in the figures, or via a plurality of orifices distributed in a circle around the first injector 22. The fuel spray 48 may also be injected in co- or contra-rotating manner relative to the gyratory flow coming from the second air admission passage 30. The axial-radial inclination of the second air admission passage 30 serves to deliver an air flow in which the speed field enhances penetration and uniform mixing of the fuel, thus enabling a second air/fuel mixing operation to be performed in the channel 57. The bowl 71 is attached to the end wall of the chamber 16 and, upstream from the series of orifices 72, it is pierced by one or more other series of orifices (not shown) in order to recover the fuel trickling over the wall 54 and thereby improve the quality of the mixing performed in the channel 57.

The air film f3 coming from the series of orifices 72 serves to control the radial expansion of the second air/fuel mixture, thus serving to limit interactions with the walls of the combustion chamber, where such interactions are harmful to its stability to withstand high temperatures. It should be observed that the orifices 72 may all be identical in size, or that they may be of sizes that vary (per sector) to serve simultaneously to control the expansion of the second air/fuel mixture towards the walls of the chamber, and also to enhance flame propagation between adjacent full-throttle modules, in particular during an ignition stage.

Figure 2:
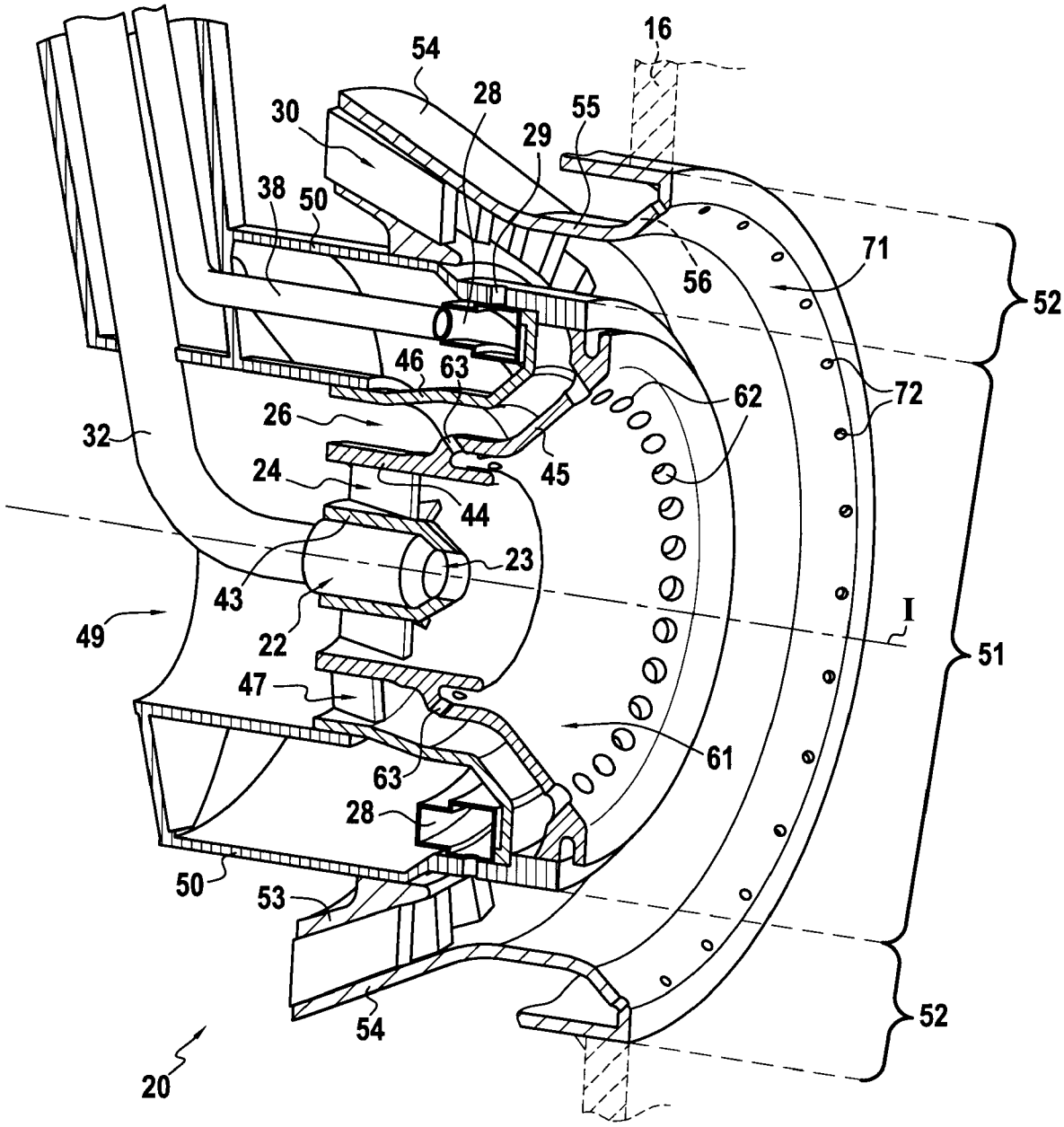
FIG. 2 shows the injector system of FIG. 1, on its own, in perspective, and in axial section on a plane including the injection axis of the first injector.

The diagram of FIG. 4 shows the various flow zones generated by the injector system of FIGS. 1 to 3. Thus, the idling module generates a backflow zone A located around the injection axis I. The characteristics of this backflow zone (volume, mean flow transit time, richness) are determined by the size of the bowl 61 and by the air flow rate of the idling module. These characteristics determine the performance of the chamber in terms of re-ignition, stability, and emissions while idling.

The second air admission passage 30, forming part of the full-throttle module, generates a direct turbulent flow in flow zone B, which is isolated from the backflow zone A by the air film f1 coming from the first series of outlet orifices 62 from the air feed duct 26, this air film f1 limiting shear and thus mixing between the zones A and B. Furthermore, the presence of the series of orifices 72 in the bowl 71 of the full-throttle module avoids gas from the flow zone B interacting with the walls of the combustion chamber 10. The full-throttle module generates a backflow zone C that is located on either side of each injector system 20, and between injector systems, at the chamber end wall. By means of these backflow zones C, the full-throttle module presents a wide stability range giving rise to a large amount of adjustment latitude concerning the transition between idling speed to full-throttle speed. It should be observed that the idling flows and the full-throttle flows mix in the downstream portion of the chamber, in the zone marked D.

At idling speed, only the idling module, and thus only the backflow zone A has fuel. The dimensioning constraints relating to the stability of the combustion area, for a given fuel flow rate corresponding to the deceleration abutment, require operation to be of the rich combustion type as soon as the International Civil Aviation Organization (IACO) idling speed is reached (7% of thrust). The presence of the mixing zone D immediately downstream from the backflow zone A makes the combustion area of the injection system a combustion area of the rich burn quick quench lean (RQL) type. The production of NOx thus remains low even with engines having thermodynamic characteristics while idling that are sufficiently severe to have the potential of leading to a significant quantity of NOx being formed (e.g. a turboprop of the TP400 type).

In full-throttle operation, the idling module and the full-throttle module are both supplied with fuel, with the way in which fuel is distributed being selected in such a manner as to achieve lean combustion, i.e. combustion that produces little NOx or smoke from either module.

The invention claimed is:

1. A fuel injector system for injecting fuel into a turbomachine combustion chamber, the system comprising:

first and second fuel injectors, the first injector being positioned at the center of the injector system so as to inject a first fuel spray, and the second injector surrounding the first injector so as to inject a second fuel spray of generally annular shape around the first fuel spray; and first and second air admission passages associated respectively with the first and second injectors in such a manner as to form respective first and second air/fuel mixtures, said injector system further comprising an air admission duct with outlet orifices opening out between the first and second injectors in such a manner as to create a separator air film between the respective combustion zones of the first and second air/fuel mixtures.

2. A fuel injector system according to claim 1, wherein the second injector presents a circular injection slot surrounding the first injector.

3. A fuel injector system according to claim 1, wherein the second injector presents a plurality of injection orifices disposed in a circle around the first injector.

4. An injector system according to claim 1, wherein the first injector, the first air admission passage, and the second injector form part of a first assembly designed to be mounted on a second assembly comprising the second air admission passage, said second assembly being designed to be mounted on said combustion chamber.

5. An injector system according to claim 1, comprising, around the first injector and in this order: the first air admission passage, the air admission duct, the second injector, and the second air admission passage.

6. An injector system according to claim 4, comprising, around the first injector and in this order: the first air admission passage, the air admission duct, the second injector, and the second air admission passage.

7. An injector system according to claim 1, wherein the first air admission passage is defined between two annular walls, an inner wall, and an outer wall, the outer wall being extended downstream by a diverging wall.

8. An injector system according to claim 7, wherein said air admission duct includes a first series of outlet orifices passing through said diverging wall near the downstream end thereof, said orifices being disposed in a circle around the first injector.

9. An injector system according to claim 8, wherein said air admission duct includes a second series of outlet orifices passing through said diverging wall upstream from said first series of outlet orifices, said orifices being disposed in a circle around the first injector.

10. An injector system according to claim 1, wherein the second air admission passage is defined between two annular walls, an inner wall, and an outer wall, the outer wall being extended downstream by a diverging wall, said diverging wall being pierced, near its downstream end, by a series of orifices disposed in a circle around the second injector.

11. A turbomachine combustion chamber fitted with an injector system according to claim 1.

12. A turbomachine combustion chamber according to claim 11, comprising inner and outer annular walls that are mutually spaced apart, a chamber end wall disposed between said annular walls in the upstream region of said chamber, and an injector system in which the first injector, the first air admission passage, and the second injector form part of a first assembly designed to be mounted on a second assembly comprising the second air admission passage, said second assembly being secured to the end wall of the chamber.

13. A turbomachine including a combustion chamber according to claim 11.

* * * * *